US005616832A

United States Patent [19]

Nauck

[11] Patent Number: 5,616,832

[45] Date of Patent: Apr. 1, 1997

[54] SYSTEM AND METHOD FOR EVALUATION OF DYNAMICS OF GOLF CLUBS

[76] Inventor: George S. Nauck, 2226 Spanish Moss Dr., Jacksonville, Fla. 32246

[21] Appl. No.: 514,869

[22] Filed: Aug. 14, 1995

[51] Int. Cl.[6] ..... A63B 53/00

[52] U.S. Cl. ..... 73/65.03; 473/221

[58] Field of Search ..... 73/65.03, 65.07, 73/65.08, 65.09, 862.541, 862.59, 584, 587; 273/186.1, 186.2, 187.4, 80 B; 33/508; 473/221, 226

[56] References Cited

U.S. PATENT DOCUMENTS

| | | | |
|---|---|---|---|
| 3,113,781 | 12/1963 | Guier | 273/186.2 |
| 3,113,782 | 12/1963 | Guier | 283/186.2 |
| 3,395,571 | 8/1968 | Murdoch | 273/77 |
| 4,070,022 | 1/1978 | Braly | 273/77 |
| 4,560,166 | 12/1985 | Emerson | 273/187.2 |
| 4,840,371 | 6/1989 | Harris | 273/187.4 X |
| 4,898,389 | 2/1990 | Plutt | 273/186.2 |
| 4,991,850 | 2/1991 | Wilhelm | 273/187.4 X |
| 5,040,279 | 8/1991 | Braly | 29/407 |
| 5,074,564 | 12/1991 | Rilling | 273/186.1 |
| 5,285,680 | 2/1994 | Sun | 73/65.03 |
| 5,332,225 | 7/1994 | Ura | 273/187.4 X |
| 5,395,116 | 3/1995 | Blaackman | 273/186.2 X |
| 5,429,008 | 7/1995 | Matsumoto et al. | 273/80 B X |

FOREIGN PATENT DOCUMENTS

| | | | |
|---|---|---|---|
| 2012768 | 8/1992 | WIPO | 273/187.2 |

*Primary Examiner*—Elizabeth L. Dougherty

[57] ABSTRACT

A system and method for evaluation of dynamics of golf clubs comprising a microphone (23) inserted inside the golf club shaft (18) which detects vibrations as sound waves and transmits signals indicative of the vibration's frequencies and amplitudes to a data acquisition system (28) for processing, display (30), and analysis. The apparatus may also be used for measuring natural frequency of flex through use of a rattler (61) or a micro-switch actuator (63).

15 Claims, 8 Drawing Sheets

Golf Shaft with sinusoidal vibration

Spectrum of Figure 3

SYSTEM AND METHOD FOR EVALUATION OF DYNAMICS OF GOLF CLUBS

BACKGROUND—FIELD OF INVENTION

This invention relates to the art of classifying golf club characteristics through dynamic as well as static measurements.

BACKGROUND—CROSS-REFERENCES TO RELATED APPLICATIONS

This invention relates to a simultaneous patent application by the present inventor. The title of the application is Improved Golf Grip for Golf Clubs. There is direct connection in the fact that the improved golf grip provides a method to modulate frequencies and amplitudes of vibration of a golf club, and the present invention provides the system and method for measuring the frequencies and amplitudes of vibration.

BACKGROUND—DESCRIPTION OF PRIOR ART

A discussion of the dynamic characteristics of a golf club would be meaningless without a discussion of the basic components of the club, all of which contribute with the golfer to determine the golf club's dynamics. For the purpose of this discussion, golf club dynamics is defined as the way a club behaves in total during a golf shot. A golf shot is defined as incorporating all of the movements of the golfer and the equipment immediately prior to, during, and immediately following a swing of a golf club in which a ball or other object is struck. Also, since both naked shafts and complete golf clubs are capable of being measured for vibrations when secured at one end, they may be defined in general as a cantilevered object. Natural frequency of flex is defined as a bench-top test to determine a low frequency oscillation of a shaft or golf club while supported at the grip end.

The basic components of the club consist of a clubhead, a shaft affixed to the clubhead at one end, and a grip which overlays the butt end portion of the shaft opposite the clubhead where the golfer places his hands to swing the club.

Golf club grips form the means for the interconnection between the golfer and his instrument, the club. The shaft is the portion which extends the golfer's reach to enable the head to reach the ball on the ground, and which is used as a lever to impart speed to the clubhead. The clubhead is that portion which is designed to strike the ball.

Normal design features of the clubhead include weighting for the purpose of increasing inertia with which to impart force to drive the ball. Clubhead speed is considered to be the greatest factor in accomplishing greater driving distances of the ball, and therefore a great deal of emphasis and effort is given to design consideration which can influence clubhead speed and moment of inertia.

The shaft is the lever by which the golfer is able to impart motion to the clubhead to produce clubhead speed. The art and technology behind shaft design is complex. A shaft must be light so that mass may be concentrated in the clubhead for maximum inertia; and it must be thin to reduce the air resistance to motion, or drag, at high speed; yet it must be strong to withstand the significant forces that result from a wide variety of conditions which occur in the hands of a golfer. The shaft is described in many ways with regard to its function, to include whip and flail. Much engineering attention has been given to designed in and measured parameters such as stiffness, weight, weight distribution, taper, flex, kick point, and torque. Shafts by their nature, being long and slender and stiff, are prone to vibration, or the ability to undergo a sinusoidal propagation of energy. Like a string of an instrument, a shaft of a particular design will have one or more natural frequencies of vibration. A vibration at a natural frequency will be sustained for longer periods. A vibration transmitted through a shaft is similar to a sound wave in that it has a distinct frequency, although the wave length may change due to changes in the shaft itself such as taper. The vibration waves have nodes or points where they complete a cycle and where movement is least, and where if obstructed by a weight or pressure the minimum effect on the vibration will be experienced. There are many things which will change the natural frequency of a shaft. These include changing the amount of weight affixed to the shaft, moving the weight or changing its distribution, changing the length of the shaft, placement of a resistance to or modifier of vibration at any point, and changing the tension and/or compression on the shaft.

It is common to classify naked shafts on a benchtop test by their natural frequency of flex, and to "frequency match" sets of shafts to be placed in a set of golf clubs. Instruments are commercially available for the measurement of a shaft's natural frequency of flex. This should be termed a static measurement rather than a dynamic measurement, as the shaft is measured on a bench and under no stress or flex representative of conditions occurring in a swing. These frequency analyzers actually only identify the natural frequency of flex, which is a very low frequency of from 180 to 360 cycles per minute. Throughout, the use of the term natural frequency of flex refers to this benchtop measurements.

U.S. Pat. No. 3,395,571 to Murdoch (8/'68) described this vibration testing method for producing a matched set of golf clubs. Filed in 1965, this method has not changed substantially in 30 years, while golf club component technology and scientific test methods have undergone a quantum leap. Nevertheless, Mr. Murdoch demonstrated profound wisdom in his analysis of the problem. From his testing, he concluded that golf clubs should be tested not only for the purpose of matching characteristics between themselves, but between them and the intended user. His invention disclosure stated that "each user has what might be termed a natural frequency of swing and that ideally the clubs of a set should each individually be matched to this frequency." This relates to the modern concept of swing tempo, and is still a sound concept. However, the problem with the ongoing practice of using bench measurements alone is that there are some other individual user parameters which affect the performance of a club in the dynamic swing event or golf shot. The size and mass of the golfer's hand, their placement location on the club, the amount of pressure exerted on the club by the grasp, and other individual factors besides tempo also influence the golf club dynamics. Using the system and method of the present invention, it has been shown that two different golfers will produce substantially different golf club dynamics when using the same golf club. There are means, however, to adjust the golf club dynamics of a given golf club to produce a preferred set of golf club dynamics for a given golf club in the use of a given golfer. The problem with the present method of frequency matching the golf club's natural frequency of flex only, is that this doesn't entirely define the golf club dynamics which are important to individual feel and performance.

U.S. Pat. No. 4,070,022 J. M. Braly (1/'78) describes a somewhat similar method to Murdoch's for producing a set of matched golf shafts and clubs. Frequency measurements are taken precisely the same, but club heads are also considered and selected for matching to the selected shafts. Again, the problem is that natural frequency of flex is only one of several frequencies of vibration that are important to golf club dynamics, and a golfer's performance and satisfaction with a given club or set of clubs.

U.S. Pat. 5,040,279 to W. K. Braly (8/'91) describes a method for producing frequency matched sets of composite golf club shafts. This recognizes the progression of golf club materials and manufacturing methods, wherein golf shafts are produced from composites which have substantially different characteristics than wood or metal. It is pointed out that club heads have undergone major changes in materials and manufacturing methods also, and have also created a need for new methods to better measure and define golf club dynamics. This method for producing frequency matched sets of composite golf club shafts suffers the same limitations previously stated relating to other frequencies of importance.

U.S. Pat. 5,285,680 to Sun (2/'94) describes a golf club measuring apparatus and method. This is an apparatus for determining the length and swing weight of a golf club. The disclosure describes swing weight as "an apparent weight related to the centrifugal force felt by the hands of the golfer swinging the club". It also provides a definition for the traditional method of classifying golf clubs according to swing weight, describing it as "the measure of a golf club's weight distribution about a fulcrum point, which is established at a specified distance from the grip end of the club". While both of these methods provide a means for classifying golf clubs relative to each other, both methods are purely static bench measurements which need additional dynamic measurements to more fully match a club or a set of clubs to an individual golfer.

In the dynamic event of a golf shot, a shaft will have more than one vibration frequency, and when two or more frequencies are even number multiples of one another, a harmonic frequency is said to exist. This is where two or more waves harmonize to create an amplitude of vibration that is larger than either of the two alone. A potential problem still exists even with frequency matched sets of shafts, in that when the club is assembled, it is often necessary to crop a portion of either the tip or the butt off the shaft. This always changes the frequencies of the shaft. Then, clubheads of varying weights are placed on the shafts which also change the frequencies of what is now not just a shaft, but a unitized head and shaft. Then the grip is applied, and the frequencies are again changed. Now the biggest problem of all is ready to be applied, and that is the golfer. Even the best golf professional cannot grip the club in the same spot and apply the same pressure time after time, and this creates variation in the club's frequencies and dynamics. All of the foregoing problems are sufficient reason that there is an ever increasing search for means to better measure a club's characteristics in the dynamic mode, and why custom club fitting is no longer a novelty. A dynamic measurement would be a measurement taken under the conditions experienced during a swing or golf shot. Fitting of golf clubs to an individual golfer's needs based on his performance characteristics is still an art more than a science. There is an ever increasing interest in finding means to characterize golf equipment performance relative to the conditions under which they will be used and to find combinations of head and shaft which perform well for an individual golfer's personal physical and swing characteristics. Every reputable equipment company is seeking its a better way to fit its clubs to the individual golfer's characteristics.

The golf grip is the fixture that forms the connection between the golfer's hands and the butt end of the shaft. It is typically designed to be replaceable, and with various construction and means to impart characteristics that are of obvious need for the application. These characteristics include: ability to be held firmly to prevent the club from slipping out of the golfer's hand during the swing; cushioning of the shock resulting from impact of the club with the ball, the ground, and other objects; and comfort and feel to the golfer's hands. The most common form of golf club grip is a round, tapered, tubular, molded elastomer which may be stretched for sliding over the butt end of the shaft and secured to the shaft by use of a paper tape with adhesive on both sides.

The United States Golf Association and The Royal and Ancient Golf Club of St. Andrews, Scotland, in concert, form the governing body for the rules of golf. The rules of golf incorporate rules for the golf ball and golf clubs and club components in addition to the rules for play. Equipment must comply with these rules to be legally used in official sanctioned events. A common specification for both grips and shafts is that they must be generally circular in cross section. The shaft will be generally straight with the same bending and twisting properties in any direction. This specification helps to reduce some of the potential for additional dynamic variation.

There are some problems and some ironies with traditional golf club design and assembly methods. With the most discriminating club designers and builders, great detail is taken in matching sets of golf club shafts with respect to the natural frequency of flex of the shafts, the amount of torque resistance and flex, the kick point, etc. However, all of these measurements are initially taken on a naked shaft, prior to placement of the clubhead, the grip, and the golfer; and therefore should be construed as static measurements. This is in spite of the realization that equipment performance is a dynamic event, in which many new variables come into play in influencing the results. These dynamic conditions include variables inherent in the equipment, such as tension and compression which result from centrifugal and bending forces applied by the swing. The dynamic conditions also include variables inherent in the golfer, such as placement of the hands, grip pressure applied by each hand, tempo of the swing and the rotation of the wrists, length of the golfer's swing arc, and clubhead speed generated in the swing. All of these dynamic properties may reduce the most careful matching of equipment static properties such as natural frequency of flex to little if any effect. For this reason, there is an increasing move to custom fitting of clubs to the individual golfer through dynamic means which evaluate the result of the combined equipment and golfer's characteristics in a dynamic evaluation. In addition, there has been a steady stream of equipment designs referred to as "player improvement" features, which are purposed to compensate for the inevitable variability and inconsistency of the golfer's individual performance. Most notable among these have been innovations in clubhead design which distribute weight in a fashion to minimize the variability of the shots resulting from mis-hits, where the ball is struck toward the heel or toe or toward the top or bottom of the clubhead instead of at the optimum center.

Ironically, the grip of the club, which is the only point of contact between the golfer and the club, has been largely devoid of innovation, improvement, and incorporation of player improvement features. Also, since grips are traditionally all pretty much the same, any affect of the grip on golf club dynamics has been pretty much ignored. "Why worry about something you can't change? might offer the best explanation for this. The lack of methods for taking measurements of golf club dynamic during actual play have served to perpetuate the ignoring of the role each component plays in the overall golf club dynamics. Without adequate means to measure golf club dynamics, some of the problems with design of traditional golf grips are not obvious, which has served to perpetuate the lack of improvements in this area.

OBJECTS AND ADVANTAGES

Accordingly, several objects and advantages of my invention are as follows:

(a) to provide a method and apparatus for classifying golf clubs during the dynamic event of the golf shot;

(b) to provide a system and method of measurement which will support the understanding of and control of vibration in a golf club;

(c) to provide a system and method to measure the multiple frequencies and harmonics of vibration which may be present in a golf club during the golf shot;

(d) to provide a system and method for identifying key points within or upon the club which will either sustain or suppress vibration, for purposes of improving the club's performance;

(e) to provide a system and method to solve the problem of using only static frequency matching of shafts and clubs when the matching may be of little value in a golf shot;

(f) to provide a system and method to measure the frequencies of a golf club so that adjustments may be made which enable the golf club dynamics to be improved;

(g) to provide a system and method for measuring the effect of an individual golfer on the golf club dynamics, and to support adjustments to obtain desired dynamics;

(h) to provide an improved method of custom club fitting through measurement of golf club dynamics;

(i) to provide another system and method of measurement to support the growing move to "game improvement" designs of equipment;

(j) to provide a system and method of dynamic measurement which will enable some quantification of the role that each individual club component plays in the overall performance;

(k) to provide support for improvements in overlooked areas such as the golf grip;

(1) to support through dynamic measurements the development of an improved golf grip which may provide new system and method for purposed changes in golf club dynamics;

(m) to support efforts to reduce shock to the golfer's hands and body through club and grip design;

(n) to support the reduction of injury and impeded performance due to shock and vibration in golf clubs;

(o) to support through dynamic measurements the development of a golf grip which reduces variation in golf club dynamics caused by hand placement and pressure;

(p) to fill the need long recognized for a method of characterizing golf clubs during the dynamic event of a golf shot by a method which is economical and practical, and may readily be taught to professionals in the trade.

(q) to provide a single apparatus and methods of use which enables both the traditional measurement of natural frequency of flex, and new measurement of golf club dynamics for more complete characterization for matching of golf clubs.

Still further objects and advantages will become apparent from a consideration of the ensuing description and drawings.

DRAWING FIGURES

REFERENCE NUMERALS IN DRAWINGS

Figure 1:
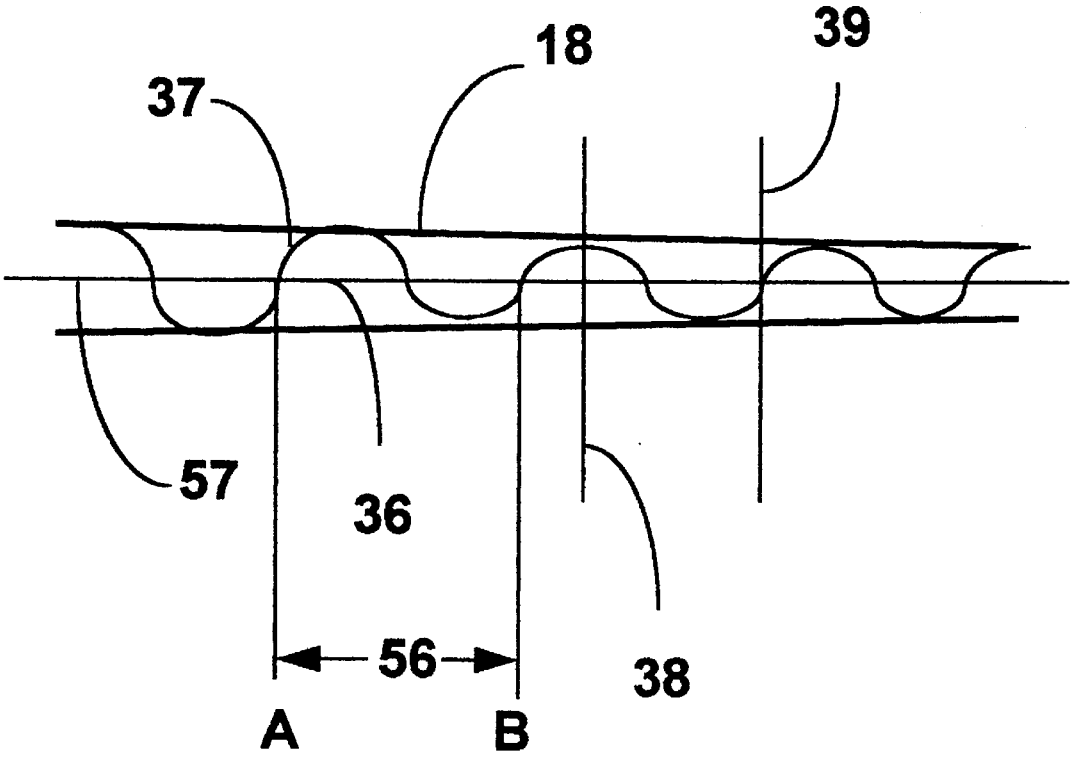
FIG. 1 shows a shaft with a sinusoidal vibration

18 Golf Club Shaft
57 Centerline
37 Sinusoidal Vibration
38 Peak of sinusoidal vibration wave
39 Node of sinusoidal vibration wave
56 One cycle of sinusoidal vibration
21 club head
22 Club grip
23 Microphone
24 Wireless transmitter
25 Antenna
26 Wireless Receiver
27 Computer
28 Data acquisition board
29 Signal processing software
30 Display
40 Sinusoidal wave of frequency three
41 Sinusoidal wave of frequency one
42 Harmonic wave of frequency one
**43*a*** Waves vibration node a
**43*b*** Waves vibration node b
**44*a*** Waves beginning measurement point
**44*b*** Waves ending measurement point
**44*c*** Middle of measurement of waves
50 amplitude scale
51 amplitude of frequency three
52 amplitude of frequency one
53 Scale of frequency
60 cage
61 rattler
62 micro-switch

63 micro-switch actuator
64 hinge
65 actuator lever
66 golf club
67 DC circuit

DESCRIPTION—FIGS. 1 TO 8

FIG. 1 shows a representation of a golf club shaft 18 with a single sinusoidal vibration the golf shaft 18 is typically tapered, or stepped and tapered, although golf shafts may be of uniform diameter over all or a portion of their length. Centerline 57 may represent both the center of the shaft and the center of the sinusoidal vibration 12 amplitude (null value). Each point at which a vibration reverses its direction is referred to as a Peak of sinusoidal vibration wave 38. The point at which the vibration wave passes through zero amplitude is shown as a Node of sinusoidal vibration wave 39. The distance between two peak values of the same sign, or the distance between three nodes of a vibration wave is referred to as a cycle, or one complete wave. The distance between A and B is a vibration wave length of one cycle of sinusoidal vibration 56. The rate at which complete cycles of a wave are completed is called the frequency of the wave, and is commonly measured in cycles per second (cps), also known as Hertz. However, the common units for expressing golf club natural frequencies of flex are cycles per minute (cpm). Although frequencies tend to remain constant running through a golf club shaft, the wave length tends to change due to changing shaft taper and/or thickness which modulates the vibration. Typically the wave length is shorter at the butt of the shaft where the diameter is typically greatest.

Figure 2:
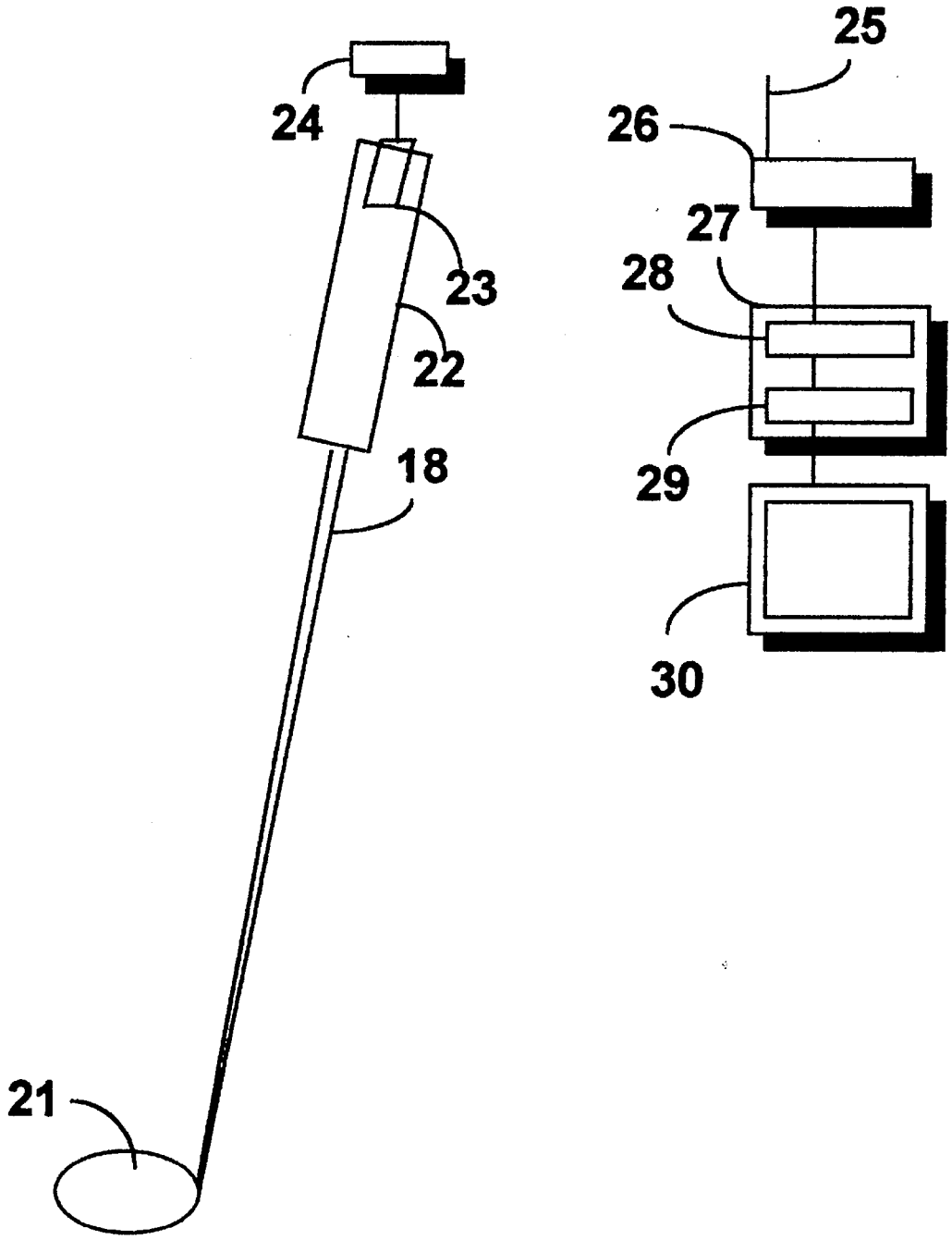
FIG. 2 shows a golf club affixed with a system for measuring golf club dynamics during a golf shot.

FIG. 2 shows a diagram of a system and method to measure the vibrations of a golf club and to produce a frequency spectrum which may be used to characterize the club in a dynamic situation. A club head 21 is attached to a Golf Club Shaft 10 with a Club grip 22. A Microphone 23 is placed in a hole at the top end of the Club grip 22. A wireless radio frequency transmitter transmits a signal indicative of the vibrations in the golf club to a Wireless Receiver 26 through an Antenna 25. The output signal from Wireless Receiver 26 is sent to Computer 27 which contains Data acquisition board 28 and Signal processing software 29. The data is manipulated in the computer to produce an analysis of the vibrations in any of a number of information formats for viewing by means of Display 30.

Figure 3:
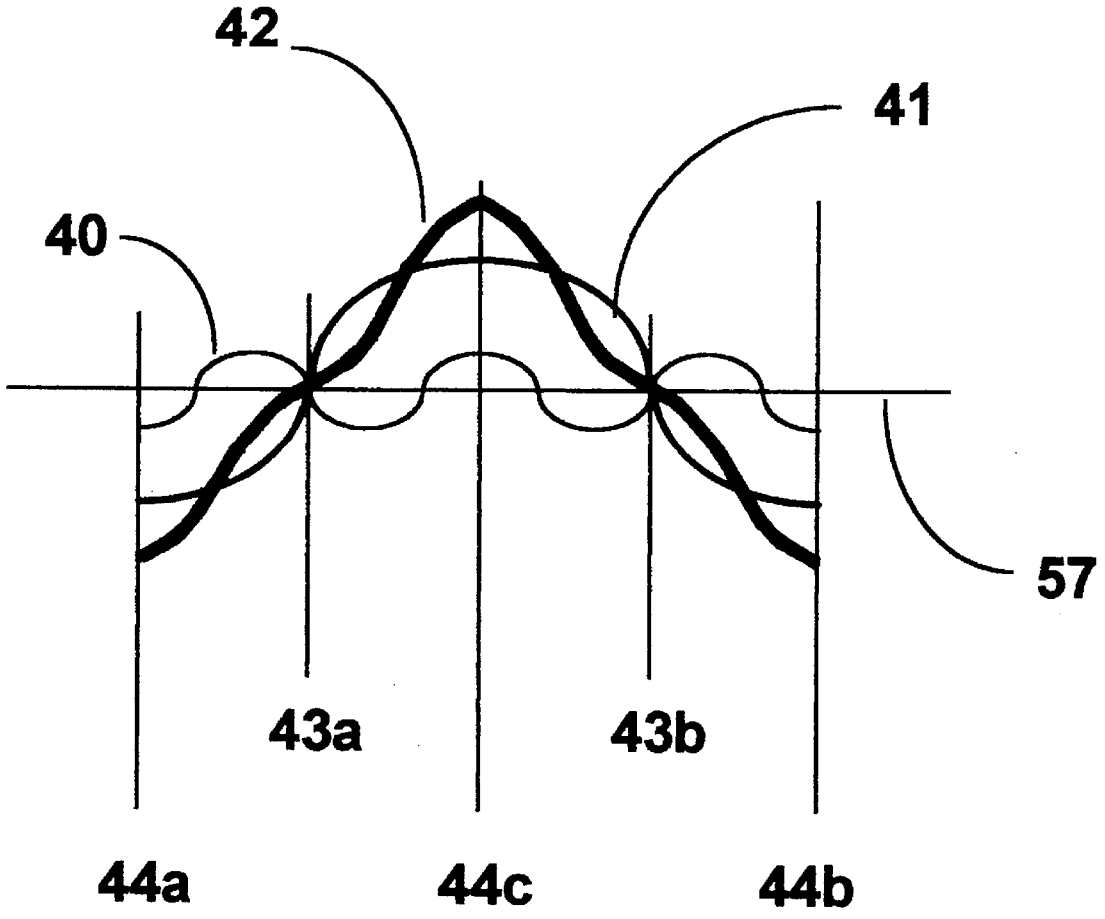
FIG. 3 shows a combination of sinusoidal waves of vibration.

FIG. 3 shows two independent sinusoidal waves, Sinusoidal wave of frequency three 40 and Sinusoidal wave of frequency one 41, and Harmonic wave of frequency one 42. The arithmetic sum of the amplitudes of two frequencies at a given point in time creates a new wave which combines features of the two original frequencies. If the frequencies of two or more waves are whole number multiples of one another, they are referred to as harmonics, which may produce amplitudes greater than any of the individual component's amplitudes. Thus, two or more minor vibrations may combine to form a major vibration. This can be detrimental to a golf club and golfer, just as it may be detrimental to structures and mechanical devices. The Waves beginning measurement point 44*a* shows Sinusoidal wave of frequency three 40 at a minimum value while Sinusoidal wave of frequency one 41 is also at a minimum value. These two waves, although at different frequencies, are also at maximum values simultaneously at Middle of measurement of waves 44*c*. This creates a Harmonic wave of frequency one 42, which has an amplitude of the sum of the amplitudes of the two frequencies of which it is composed. The points at which the waves pass through zero amplitude are called vibration nodes, and are shown in the figure as Waves vibration node a 43*a* and Waves vibration node b 43*b*. At a node of vibration in a shaft, very minimal vibration will be felt, and the touch will have very small effect on the vibration. On the other hand, touching a shaft where a wave peak exists will allow a very strong vibration to be felt, and pressure at this point will reduce the vibration through absorption of the energy. Thus, it should be seen how this knowledge may be used in controlling the effects of the vibrations of a golf shot on the golfer.

Figure 4:
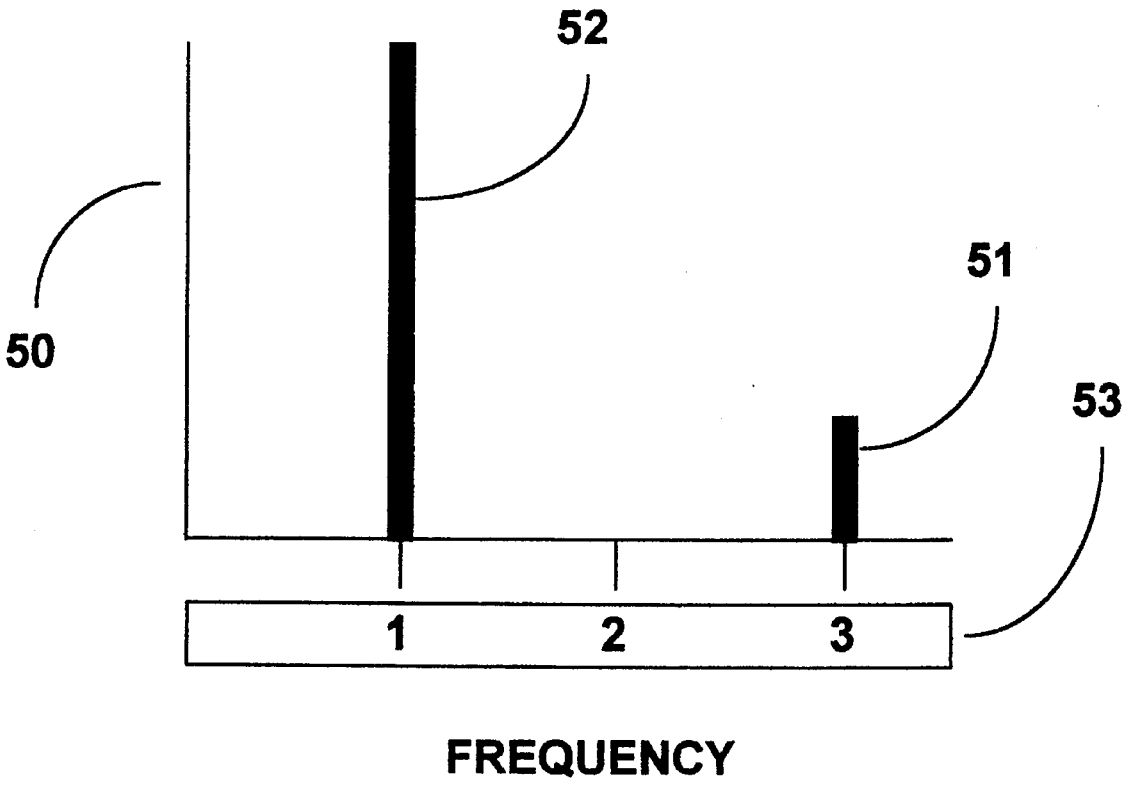
FIG. 4 shows a frequency spectrum of a combination of the sinusoidal waves of vibration of FIG. 3.

FIG. 4 shows a frequency spectrum of a combination of the sinusoidal waves of vibration of FIG. 3. This is an x-y plot of frequency and amplitude. The y axis shows amplitude scale 50 of wave of frequency three 51 and wave of frequency one 52. The x axis is the Scale of frequency 53.

Figure 5:
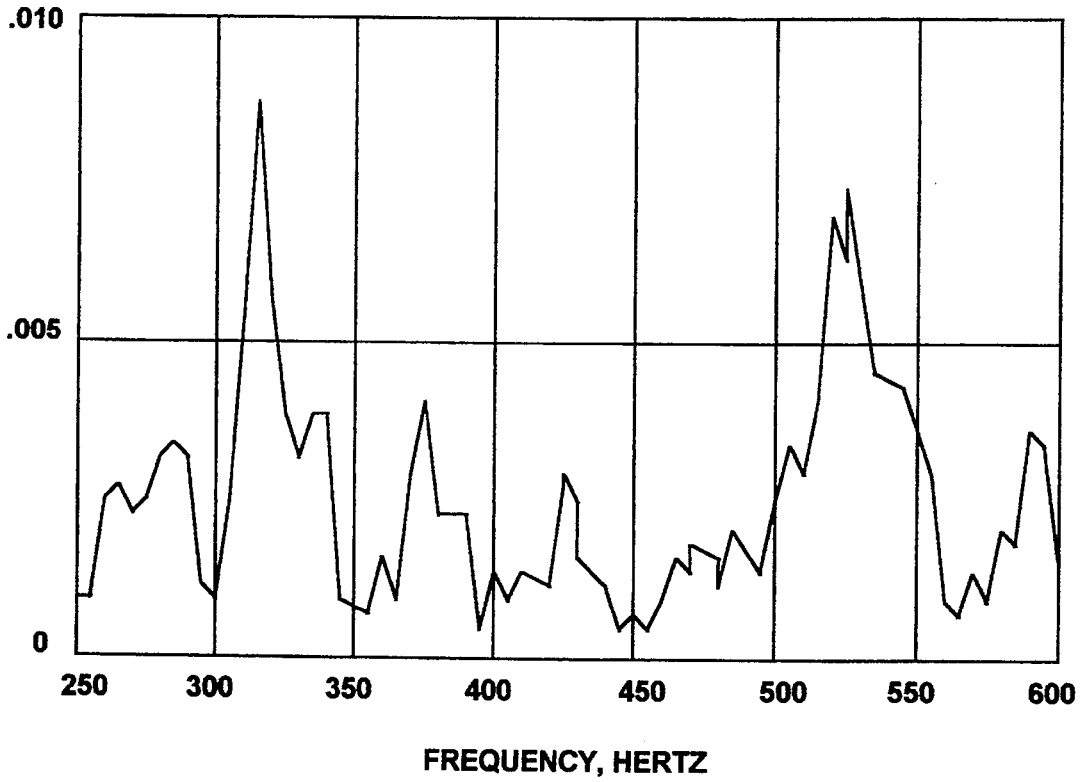
FIG. 5 shows a frequency spectrum of a standard 7 Iron dynamic frequency spectrum of golf dynamics measured with the present invention.

FIG. 5 shows golf club dynamics as define by a frequency spectrum of vibrations in a standard 7 Iron, as measured with the present invention. It is noted that two dominant frequencies exist. One is at a frequency of around 320 Hertz and one is at around 520–525 Hertz. The maximum amplitude is at only 0.09, and the second frequency is not an even number multiple, so no harmonic frequency exists.

Figure 6:
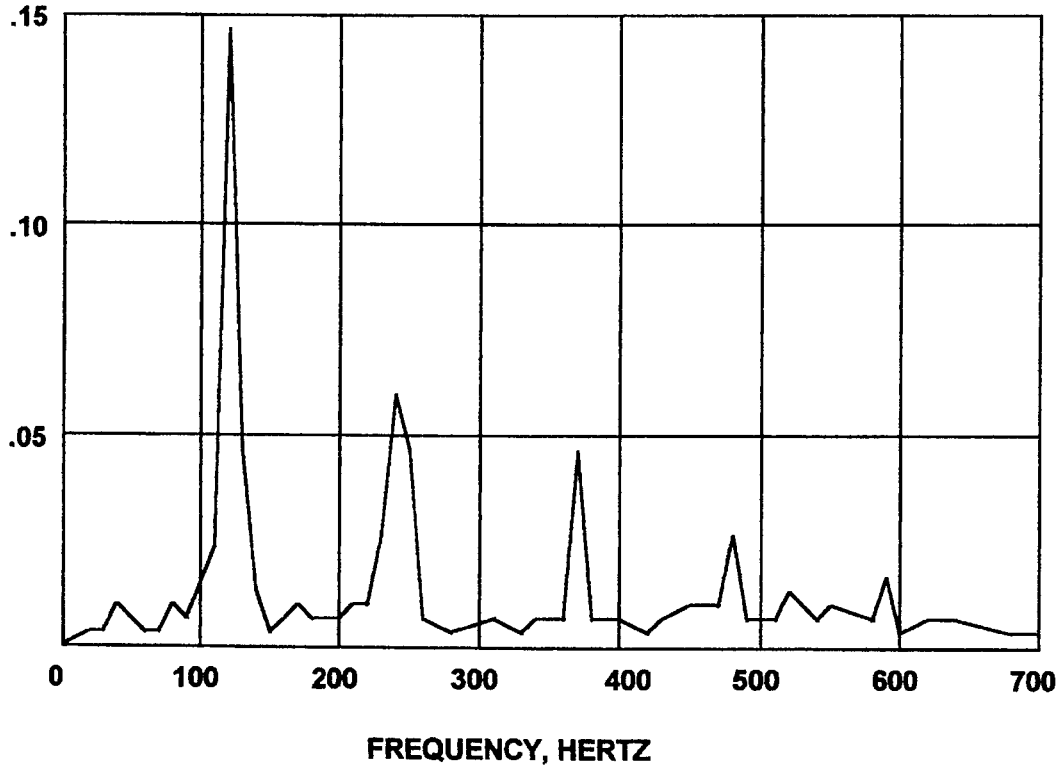
FIG. 6 shows a frequency spectrum of golf club dynamics of the 7 Iron of FIG. 5 after weight was shifted at the grip, measured with the present invention.

FIG. 6 shows a frequency spectrum of vibrations in the same 7 Iron as in FIG. 6, but after some weight was added to the grip of the club. There is a clear pattern of harmonic vibrations with even number multiples of around 118 Hertz. Multiples: 2=236; 3=354; 4=472; 5=590. The amplitude of the 118 Hertz frequency is about 0.146, about 62% higher than before the adjustment was made. This will produce significantly more shock on the golfer's body. Traditional methods of club measurements overlook these phenomena. The present invention provides a system and method to measure this phenomena so that a method of control may be initiated and evaluated.

Figure 7:
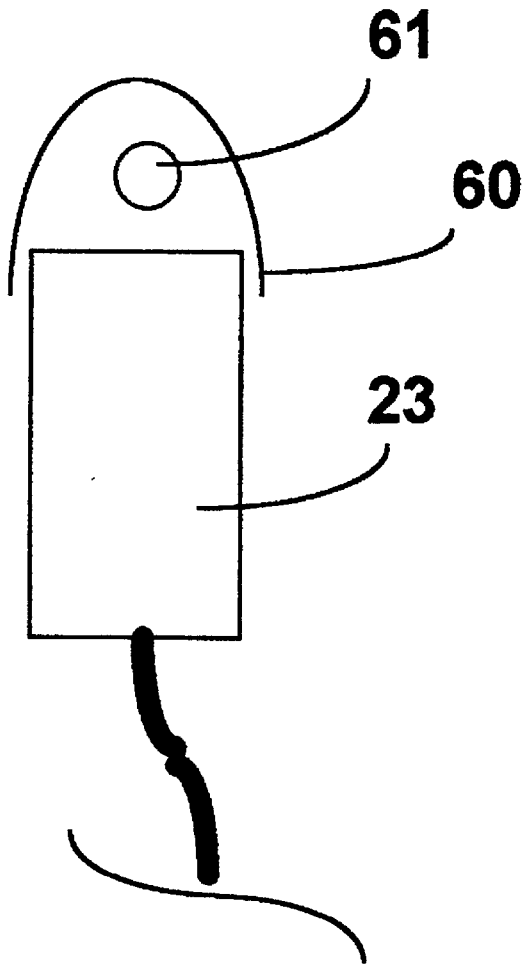
FIG. 7 shows a wireless microphone equipped with a cage and rattler for use in measuring natural frequency of flex.

FIG. 7 shows a wireless microphone 23 equipped with a cage 60 to contain a rattler 61. This enables the apparatus to be used as an alternative to existing apparatus for measurement of the natural frequency of flex on a benchtop. The wireless microphone 23 is attached to the end of the horizontal golf club or golf club shaft, which is supported at the grip end. When the club or shaft is strummed, the microphone oscillates up and down with the club or shaft. As the microphone 23 oscillates up and down, the rattler 61 contained by the cage 60 creates a noise indicative of the frequency of the oscillation or natural frequency of flex.

Figure 8:
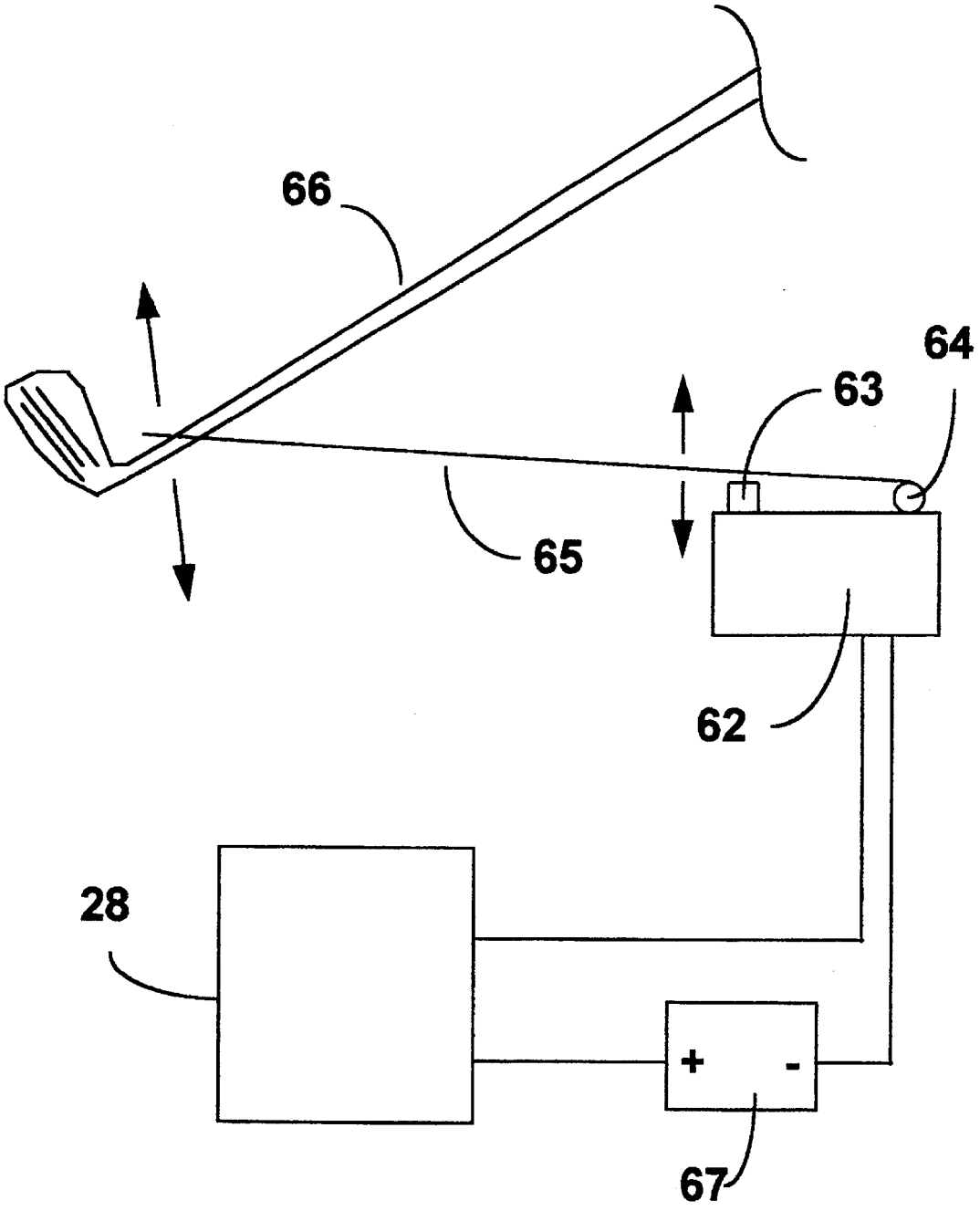
FIG. 8 shows a DC circuit energized by an actuator and micro-switch arrangement for measuring a club's natural frequency of flex.

FIG. 8 shows another embodiment of the apparatus in the application for measuring the natural frequency of flex. A DC circuit 67 and a micro-switch 62 are arranged to measure natural frequency of flex of a golf club 66. The actuator lever 65 connected to the hinge 64 actuates the micro-switch actuator 63 each time the golf club 66 makes a cycle. Voltage is supplied to the data acquisition board 28 at a frequency indicative of the natural frequency of flex of the golf club 66.

OPERATION

In a simultaneous invention filing by the present inventor, an improved golf grip is disclosed which includes means for adjusting the dynamic performance of a golf club through the grip design and configuration. In order to maximize the utility of this adjustable feature, a means for measurement of the overall dynamics of the club is needed. The primary dynamic properties that are influenced by the club grip are club vibration frequencies and amplitudes. There has been no means for measurement of these parameters in the past. Among the benefits that are derived from this method of dynamic club measurement are several objects and advantages of the improved golf grip invention. They are:

(1) Ability to reduce shock to the golfer's hands and body resulting from impact of the club with the ball or object, and transmitted by the grip to the golfer—Professional golfers are prone to injury and incapacitation from the frequent, repetitive shock absorbed by their hands and limbs and body through impacting a ball or object with the golf club. All golfers experience the same shock, albeit less frequently and perhaps of less severity. The golf grip is only one of several design considerations for reducing this shock to the golfer. One of the shock producing phenomena is the vibration which is propagated up the shaft through the dynamics of the golf swing and club impact with objects. If the combination of golf club components and the connection to the golfer creates a harmonic vibration, the resulting shock to the golfer can be severe. A golf club grip is a part of the club which has a part in determining the frequency or plurality of frequencies at which the club is tuned, and the magnitude and duration of these vibrations.

(2) Ability to provide a golf grip which removes or reduces effects of varying hand placement and pressures on the dynamic action of the shaft and club;

(3) Ability to provide a golf grip which is capable of adjustment in the way that it affects the overall dynamics of a golf club.

The present invention, with its provision of a quantitative and qualitative means of measurement of the shock and vibrations in a golf club under the actual dynamics of the golf shot provides the basis for realizing these and other improvements in golf club design. In addition, it overcomes some shortcomings of all prior methods for classifying golf clubs relative to golfer characteristics by providing additional meaningful dynamic measurements and means for analysis of the measurements.

The golf club is designed and built to produce one thing, a golf shot. A golf shot is a dynamic event, and there is an increasing awareness of the void of means to obtain information about the dynamics of the golf club during the golf shot. Video analysis of the golfer and the club is commonly used, but the information that can be gleaned from video analysis consists of only such things as tempo of the swing, speed of the moving club at various points, and such information about shaft flex and twist as may be able to be gleaned from video photography. While measurements are made of shaft natural frequency of flex in a static situation, no means previously existed to measure frequencies of the club with a golfer's hands affixed during the dynamic event of a shot. The dynamic event of the swing and contact with the ball or other object creates vibrations in the golf club. These vibrations will contain one or more frequencies of significant amplitude. Vibrations of significant amplitude, or sudden vibrations referred to as shock, are detrimental to the golfer and his performance. While the commonly measured golf club natural frequency of flex is typically between 180 and 360 cycles per minute (cpm), these dynamic vibrations from the struck ball will be typically from 40 to more than 1000 cycles per second (cps) which is commonly referred to as Hertz.

There is a good deal of known science pertaining to vibrations, and how to control them. However, control of vibrations is a hit and miss situation and a subjective activity unless methods are available to measure the vibrations. The only vibration measurements used routinely by golf equipment manufacturers are measurements of vibration in components and clubs on the test bench through use of a machine to vibrate the shaft to determine its natural frequency of flex. It can be shown that vibrations in a golf club are influenced by anything that is added as a component of the club or that contacts the club. Some factors influence vibration frequency and some influence vibration amplitude, while typically both frequency and amplitude will be influenced.

There are certain points on a vibrating golf club where a given action will produce more or less effect on the vibrations. As discussed in the discussion of FIGS. 1 and 3, there are points where vibration nodes are present, and application of pressure, mass, or interference will have little effect if applied at this point. Then there are points of large amplitude where application of pressure, mass, or interference will have great effect if applied at these points. There is a simple demonstration of this principle. If one grips a golf club lightly between the thumb and index finger and imparts a vibration to the club at any point, a certain amount of vibration will be felt. Moving the point of contact up or down will locate one or more spots where the vibrations will be felt distinctly and will be prolonged, but will not be abrupt. This is a vibration node of sinusoidal vibration wave 39. Moving the fingers to points above or below this point will more quickly dampen the vibration, but with more shock to the fingers where the vibrations are absorbed. This demonstrates the principle to be opportunized by the present invention, and especially when used in concert with co-pending invention of a golf grip with means for modulating the golf club dynamics. This knowledge can be used to advantage in controlling the vibrations inherent in the dynamic event of a golf shot. However, there are numerous factors which impact the dynamics of the golf shot besides mass, mass distribution, and points of contact. The tempo of the swing coupled with the amount of flex in the shaft, for instance, creates bending of the shaft which puts unequal tension or compression in the shaft. Centrifugal force also comes into play and is present in varying degrees based on tempo and swing speed. Therefore, there is a need to be able to take numerous dynamic measurements of vibration from a given club with a given golfer in order to cover the range of variability, and to define how adjustments may be made to improve performance results over this range. This has created the need for a simple method for measuring numerous golf shots for the dynamic characterization of golf clubs, defined as golf club dynamics. Such a method is the object of the present invention.

FIG. 2 shows the basics of the system and method for dynamic evaluation of golf clubs. Vibrations created by the dynamic swing event and the impact with a ball or other object create vibrations that travel all through the golf club, and ultimately to the golfer's hands and body. These vibrations may be read as sound waves by placing a microphone in the shaft of the golf club. This is done by inserting a small microphone in a hole at the butt end of the golf grip. By using a wireless microphone such as an FM wireless microphone which is common to standard sound systems, only a small thin wire is required to connect the microphone to the transmitter, which may be conveniently attached to the golfer without interfering with the dynamics of the swing. The sound waves from the club are received by the transmitter 24 and transmitted to the receiver 26 through the antenna 25. The receiver 26 sends output signals to the computer 27 and into the data acquisition board 28. The data acquisition board processes and stores the data relating to the signals for use by data analysis software 29. This software analyzes the data to provide graphic and tabular information relative to the vibration frequencies. The vibration amplitudes and frequencies are determined, as well as the frequency spectrum. This provides a basis for characterizing the golf club dynamics during the golf shot event. By taking multiple measurements, a profile of golfer and club performance is developed. This forms a basis of comparison when changes are made in the golfer or the equipment. Changes that produce vibrations with higher amplitudes are negative. It is preferred to reduce vibrations and shock amplitude to a minimum. The apparatus is primarily intended to enable measurements of golf club dynamic properties, but it may also be used to measure the traditional natural frequency of flex.

Although there are currently commercial instruments available for measuring the natural frequency of flex of a shaft or golf club, the present invention provides a method for this same type of measurement of very low frequencies in addition to the higher frequency golf club dynamic measurements. Typically, this low frequency of vibration of the natural frequency all flex may not produce sufficiently strong sound waves to be detected by a standard wireless microphone. There are a number of solutions to this. We describe two embodiments of this method for example.

Example one as illustrated in FIG. 7 is a tiny cage over the end of the microphone with a small metal rattler in it, such as an air rifle b-b. With the microphone in an upright position affixed to the end of the club or shaft in a horizontal position, the rattler is resting on the face of the microphone. When the shaft is strummed and put in a flexing vibration, the rattler is thrown up and down at the frequency of the vibration, and it is heard clearly by the microphone, giving a clearly readable and highly accurate frequency pattern indicative of the natural frequency of flex.

Example 2, illustrated in FIG. 8, is the use of a micro switch with an actuating lever that is actuated by the up or down cycle of the golf club shaft flex. A simple DC circuit of for instance 1.5 to 5.0 volts is fed to the data acquisition board through the micro switch, again creating a very accurate frequency pattern indicative of the natural frequency of flex. In this type of static test of flexure frequency, the amplitude is not an important factor, so the constant DC voltage alternating on and off is sufficient to the purpose.

SUMMARY, RAMIFICATIONS, AND SCOPE

Summarizing the present invention encompasses, in combination, apparatus and methods for measuring vibration amplitudes and frequencies present in the shaft of a golf club during the dynamic event of a golf shot. These frequencies and amplitudes of vibration are adjustable by various means available to the skilled club-maker and club-fitter. An analysis of the vibration frequency spectrum, with amplitudes, allows problems with the combined golfer versus club dynamics to be identified. Once identified, various means may be employed to improve the dynamics which result in better golfer performance and reduced stress and injury to the golfer's body due to vibration and shock. The apparatus for analysis of golf club dynamics consists of a wireless microphone which may be inserted into the upper end of the shaft through the hole in the butt end of the grip, a receiver for the wireless microphone, and a data acquisition system with software to process the signals into a form which is readily analyzed. The method for measuring golf club dynamics encompasses the use of a wireless microphone to detect the vibration frequencies and the relative vibration amplitudes of the shaft vibrations as these vibrations are transferred to the microphone in the form of sound waves. The vibration are then broken into a frequency spectrum through use of the data acquisition system and software, where they are analyzed for undesirable dynamic characteristics as determined by vibration frequencies and amplitudes. The detection and elimination of harmonic frequencies is especially useful in reducing the level of shock and vibration and resultant golfer stress and injury. Using this source of immediate dynamic information, the club-maker or club-fitter may make adjustments to the club on the spot, such as adding or subtrating mass to the clubhead, making changes to the grip, changing the shaft or the shaft length, and so forth. Changes may then be immediately evaluated by taking another dynamic measurement using the apparatus and method. By using other elements of the invention, such as a rattler and cage affixed to the golf club head or a micro switch and lever placed near the golf club head, the apparatus may be used for the dual purpose of obtaining the traditional static measurement of the shaft's or club's natural frequency of flex with the club's grip end affixed in a bench mount. This static measurement is well known to the trade, but is done with an apparatus specifically developed for this type of measurement, such apparatus being unable to perform the type of golf club dynamics measurements achievable by this invention. This invention enables the old form of measurement, natural frequency of flex, and the new form of measurement that is the subject of this invention, golf club dynamics vibration frequency and amplitude, to both be accomplished with one basic measurement system.

Since computers are becoming common tools for golf professionals and for golf facilities, this system and method provides a simple and economic approach to equipping them with useful performance measurement tools. It is clear that the invention may be used for other similar purposes in sports and industry. For example, attachment to a tennis racket would tell something about the stringing of the racket and/or the impact with the ball. It is obvious that means other than the wireless means may be reasonably substituted, provided that reasonable accommodation is given to the routing of wires so as not to impede performance and mobility of the golfer and equipment.

Thus the scope of the invention should be determined by the appended claims and their legal equivalents, rather than by the examples given.

I claim:

1. A method for measuring golf club dynamics and quantifying conditions of potential hazard to a golfer's body comprising the steps of:

employing at least one sensing means inside the shaft of a golf club for sensing of golf club dynamics;

employing conducting means for conducting of sensed golf club dynamics to at least one transmitting means;

employing at least one transmitting means for transmission of said sensed golf club dynamics;

employing at least one receiving means for reception of said transmission of said sensed golf club dynamics;

wherein golf club dynamics comprise vibration frequencies and amplitudes present in the shaft.

2. A method as in claim 22 further comprising the steps of:

employing at least one transferring means for transferring of said sensed golf club dynamics to processing means;

employing processing means for processing of said sensed golf club dynamics into human readable indicia.

3. A method as in claim 2 further comprising the steps of:

employing display means for display of said human readable indicia;

employing analysis means for analysis of said human readable indicia.

4. A method as in claim 3 wherein:

said at least one sensing means is at least one microphone.

5. A method as in claim 4 wherein:

said conducting means is physical connection between said at least one microphone and said at least one transmitting means.

6. A method as in claim 5 wherein:

said at least one transmitting means is at least one wireless transmitter;

said at least one reception means is at least one receiver of signals transmitted from said at least one wireless transmitter;

said at least one transferring means is at least one physical connection from said at least one receiver of said signals to said processing means;

said processing means is at least one data acquisition system;

said display means is configured to display output signals of said human readable indicia from said at least one data acquisition system;

said analysis means is software for said analysis of said human readable indicia;

said conditions of potential hazard to a golfer's body are golf club dynamics comprising vibration and shock.

7. An apparatus for measuring golf club dynamics and golf club natural frequency of flex comprising:

at least one sensing means inside the shaft of a golf club for sensing of golf club dynamics;

conducting means for conducting of sensed golf club dynamics to at least one transmitting means;

at least one transmitting means for transmission of said sensed golf club dynamics;

at least one receiving means for reception of said transmission of said sensed golf club dynamics;

wherein said golf club dynamics comprise vibration frequencies and amplitudes present in the shaft.

8. An apparatus as in claim 7 further comprising:

at least one transferring means for transferring of said sensed golf club dynamics to processing means;

processing means for processing of said sensed golf club dynamics into human readable indicia;

display means for display of said human readable indicia;

analysis means for analysis of said human readable indicia.

9. An apparatus as in claim 8 wherein:

said at least one sensing means is at least one microphone.

10. An apparatus as in claim 9 wherein:

said conducting means is physical connection between said at least one microphone and said at least one transmitting means.

11. An apparatus as in claim 10 wherein:

said at least one transmitting means is at least one wireless transmitter;

said at least one receiving means is at least one receiver of signals transmitted from said at least one wireless transmitter;

said at least one transferring means is at least one physical connection from said at least one receiver of said signals to said processing means;

said processing means is at least one data acquisition system;

said display means is configured to display output signals of said human readable indicia from said at least one data acquisition system;

said analysis means is software for said analysis of said human readable indicia;

said human readable indicia includes vibration frequency spectrum.

12. An apparatus as in claim 11 further comprising:

signal producing means for producing a signal indicative of golf club natural frequency of flex.

13. An apparatus as in claim 12 wherein golf clubs may be classified relative to one another in both the bench test mode and the dynamic golf shot mode.

14. An apparatus for measuring golf club dynamics and golf club natural frequency of flex comprising:

at least one sensing means inside the shaft of a golf club for sensing of said golf club dynamics;

conducting means for conducting of sensed golf club dynamics to at least one transmitting means;

at least one transmitting means for transmission of said sensed golf club dynamics;

receiving means for reception of said transmission of said sensed golf club dynamics;

transferring means for transferring of said sensed golf club dynamics;

processing means for processing of said sensed golf club dynamics into human readable indicia;

display means for display of said human readable indicia;

analysis means for analysis of said human readable indicia;

wherein said golf club dynamics comprise vibration frequencies and amplitudes present in the shaft, and said natural frequency of flex comprises a frequency of shaft flexure with the grip in a rigid fixture.

15. An apparatus as in claim 14 wherein:

said at least one sensing means is at least one microphone;

said conducting means is physical connection between said at least one microphone and said at least one transmitting means;

said at least one transmitting means is at least one wireless transmitter;

said at least one receiving means is at least one receiver of signals transmitted from said at least one wireless transmitter;

said transferring means is at least one physical connection from said at least one receiver of said signals to said processing means;

said processing means is at least one data acquisition system;

said display means is configured to display output signals of said human readable indicia from said at least one data acquisition system;

said analysis means is software for said analysis of said human readable indicia;

said human readable indicia includes vibration frequency spectrum;

actuating means is provided for actuating a signal indicative of said golf club natural frequency of flex;

said golf club natural frequency of flex is measured by actuation of a signal indicative of said natural frequency of flex.

* * * * *